US007483004B2

(12) United States Patent
Kim

(10) Patent No.: US 7,483,004 B2
(45) Date of Patent: Jan. 27, 2009

(54) PIXEL, ORGANIC LIGHT EMITTING DISPLAY COMPRISING THE SAME, AND DRIVING METHOD THEREOF

(75) Inventor: Hong Kwon Kim, Euiwang (KR)

(73) Assignee: Samsung SDI Co., Ltd, Suwon-si (KR)

( * ) Notice: Subject to any disclaimer, the term of this patent is extended or adjusted under 35 U.S.C. 154(b) by 404 days.

(21) Appl. No.: 11/245,988

(22) Filed: Oct. 6, 2005

(65) Prior Publication Data

US 2006/0092107 A1 May 4, 2006

(30) Foreign Application Priority Data

Oct. 13, 2004 (KR) ..... 10-2004-0081809

(51) Int. Cl.
*G09G 3/32* (2006.01)

(52) U.S. Cl. ..... 345/82; 345/76; 345/690; 345/211; 315/169.1; 315/169.3

(58) Field of Classification Search ..... 345/76, 345/77, 82–84, 690, 692, 211–214; 315/169.1–169.3; 313/497–506
See application file for complete search history.

(56) References Cited

U.S. PATENT DOCUMENTS 6,008,588 A 12/1999 Fujii
6,587,086 B1 * 7/2003 Koyama ..... 345/77
6,847,341 B2 * 1/2005 Kimura et al. ..... 345/78
7,129,918 B2 * 10/2006 Kimura ..... 345/82
7,330,162 B2 * 2/2008 Yamazaki et al. ..... 345/82
7,330,169 B2 * 2/2008 Koyama ..... 345/77

FOREIGN PATENT DOCUMENTS

JP 6-230745 8/1994

OTHER PUBLICATIONS

Patent Abstracts of Japan; Publication No. 06-230745; Publication Date: Aug. 19, 1994; in the name of Sato.

* cited by examiner

*Primary Examiner*—Henry N Tran
(74) *Attorney, Agent, or Firm*—Christie, Parker & Hale, LLP

(57) ABSTRACT

A pixel, an organic light emitting display including the same, and a driving method thereof, in which a gradation is represented using the frequency characteristic of an organic light emitting diode. The organic light emitting display includes a plurality of pixels which are connected by a plurality of scan lines for supplying scan signals, a plurality of data lines for supplying data signals, and a plurality of power source lines, each pixel having: a frequency supplying line through which a frequency signal corresponding to a sub-frame is supplied; a pixel circuit outputting a current corresponding to an output obtained by applying a logical operation to a corresponding one of the data signals and the frequency signal; and an organic light emitting diode for emitting light based on the current outputted from the pixel circuit. With this configuration, a desired gradation can be represented using the frequency characteristic of the organic light emitting diode on the basis of the sum of various brightness depending on a digital data signal and frequency signals that are different per sub-frame.

18 Claims, 8 Drawing Sheets

PIXEL, ORGANIC LIGHT EMITTING DISPLAY COMPRISING THE SAME, AND DRIVING METHOD THEREOF

CROSS-REFERENCE TO RELATED APPLICATIONS

This application claims priority to and the benefit of Korean Patent Application No. 10-2004-0081809, filed on Oct. 13, 2004, in the Korean Intellectual Property Office, the entire disclosure of which is incorporated herein by reference.

BACKGROUND

1. Field of the Invention

The present invention relates to an organic light emitting display, and more particularly, to a pixel, an organic light emitting display including the same, and a driving method thereof, in which a gradation is represented using the frequency characteristic of an organic light emitting diode.

2. Discussion of Related Art

Recently, various flat panel displays have been developed as alternatives to a relatively heavy and bulky cathode ray tube (CRT) display. The flat panel display includes a liquid crystal display (LCD), a field emission display (FED), a plasma display panel (PDP), a light emitting diode (LED) display, etc.

Among the flat panel displays, the light emitting diode display can emit light for itself by electron-hole recombination to allow a fluorescent layer thereof to emit the light. The light emitting diode display can be classified into an inorganic light emitting diode display and an organic light emitting diode (OLED) display according to materials and structures thereof. Here, the organic light emitting diode display can also be referred to as an organic light emitting display or an electroluminescent display.

Unlike the liquid crystal display (LCD) requiring a separate light source, an organic light emitting display has an advantage of fast response time like the CRT display.

FIG. 1 is a circuit diagram of a pixel provided in a conventional organic light emitting display.

Referring to FIG. 1, a pixel 11 of a conventional organic light emitting display is disposed in a region where a scan line Sn intersects (or crosses) a data line Dm. The pixel 11 is selected when a scan signal is applied to the scan line Sn, and emits light based on a data signal applied to the data line Dm.

The pixel 11 is connected to a first power source VDD and a second power source VSS, and includes an organic light emitting diode OLED and a pixel circuit 40.

The organic light emitting diode OLED includes an anode electrode connected to the pixel circuit 40, and a cathode electrode connected to the second power source VSS.

The organic light emitting diode OLED includes an emitting layer, an electron transport layer, and a hole transport layer, which are interposed between the anode electrode and the cathode electrode. Additionally, the organic light emitting diode OLED may include an electron injection layer, and a hole injection layer. In this organic light emitting diode OLED, when a voltage is applied between the anode electrode and the cathode electrode, electrons emitted from the cathode electrode are moved to the emitting layer via the electron injection layer and the electron transport layer, and holes generated from the anode electrode are moved to the emitting layer via the hole injection layer and the hole transport layer. Then, the electrons from the electron transport layer and the holes from the hole transport layer are collided and recombined with each other in the emitting layer, thereby emitting the light.

The pixel circuit 40 includes a first transistor M1, a second transistor M2, and a capacitor C. Here, each of the second transistor M2 and the first transistor M1 includes a p-type metal oxide semiconductor field effect transistor (MOSFET). Also, the second power source VSS has a lower voltage level than the first power source VDD. For example, the second power source VSS has a ground voltage level.

The first transistor M1 includes a gate electrode connected to the scan line Sn, a source electrode connected to the data line Dm, a drain electrode connected to a first node N1. Here, the first transistor M1 supplies the data signal from the data line Dm to the first node N1 in response to the scan signal supplied to the scan line Sn.

The capacitor C stores a voltage corresponding to the data signal applied to the first node N1 via the first transistor M1 while the scan signal is supplied to the scan line Sn, and then keeps the second transistor M2 turned on when the first transistor M1 is turned off.

The second transistor M2 includes a gate electrode connected to the first node N1 to which the drain electrode of the first transistor M1 and the capacitor C are connected in common, a source electrode connected to the first power source VDD, and a drain electrode connected to the anode electrode of the organic light emitting diode OLED. Here, the second transistor M2 adjusts the amount of current in correspondence to the data signal supplied from the data line Dm and applied to the organic light emitting diode OLED. Thus, the organic light emitting diode OLED emits light based on the current supplied from the first power source VDD via the second transistor M2.

The pixel 11 operates as follows. First, while the scan signal of a low state is applied to the scan line Sn, the first transistor M1 is turned on. Then, the data signal is supplied from the data line Dm to the gate electrode of the second transistor M2 via the first transistor M1 and the first node N1. At this time, the capacitor C stores a voltage corresponding to the voltage difference between the gate electrode of the second transistor M2 and the first power source VDD.

Thus, the second transistor M2 is turned on by the voltage applied to the first node N1, and supplies the current corresponding to the data signal to the organic light emitting diode OLED. Hence, the organic light emitting diode OLED emits light based on the current applied from the second transistor M2, thereby displaying an image.

Then, while the scan signal of a high state is applied to the scan line Sn, the second transistor M2 is kept being turned on by the voltage corresponding to the data signal stored in the capacitor C, so that the organic light emitting diode OLED emits light and displays an image in one frame.

Further, a conventional organic light emitting display additionally may include a compensation circuit (not shown) to compensate for the non-uniformity of the threshold voltages of a plurality of second transistors (e.g., the second transistor M2) due to a manufacturing process. However, although the conventional organic light emitting display may include the compensation circuit to operate in an offset compensation manner or a current programming manner, there is still a limit to display an image with uniform brightness.

SUMMARY OF THE INVENTION

Accordingly, it is an embodiment of the present invention to provide a pixel, an organic light emitting display including the same, and a driving method thereof, in which a gradation is represented using the frequency characteristic of an organic light emitting diode.

One embodiment of the present invention provides an organic light emitting display including a plurality of pixels which are connected by a plurality of scan lines for supplying scan signals, a plurality of data lines for supplying data signals, and a plurality of power source lines, each pixel including: a frequency supplying line through which a frequency signal corresponding to a sub-frame is supplied; a pixel circuit outputting a current corresponding to an output obtained by applying a logical operation to a corresponding one of the data signals and the frequency signal; and an organic light emitting diode for emitting light based on the current outputted from the pixel circuit.

One embodiment of the present invention provides an organic light emitting display including: a pixel portion including a plurality of pixels which are connected to a plurality of scan lines, a plurality of data lines, a plurality of power source lines and a plurality of frequency supplying lines, and emitting light based on a current depending on a logical operation applied between a digital data signal supplied to the data lines and a frequency signal supplied to the frequency supplying lines; a data driver supplying the data signal to at least one of the data lines; a scan driver supplying a scan signal to at least one of the scan lines; and a frequency supply supplying the frequency signal to at least one of the frequency supplying lines.

One embodiment of the present invention provides a pixel including: a pixel circuit outputting a current corresponding to an output obtained by applying a logical operation to an input data signal and a frequency signal; and an organic light emitting diode emitting light based on the current outputted from the pixel circuit.

One embodiment of the present invention provides a method of driving a pixel, the method including: outputting a current corresponding to an output obtained by applying a logical operation to an input data signal and a frequency signal; and controlling an organic light emitting diode to emit light based on the outputted current.

BRIEF DESCRIPTION OF THE DRAWINGS

The accompanying drawings, together with the specification, illustrate exemplary embodiments of the present invention and together with the description serve to explain the principles of the invention.

DETAILED DESCRIPTION

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

Figure 1:
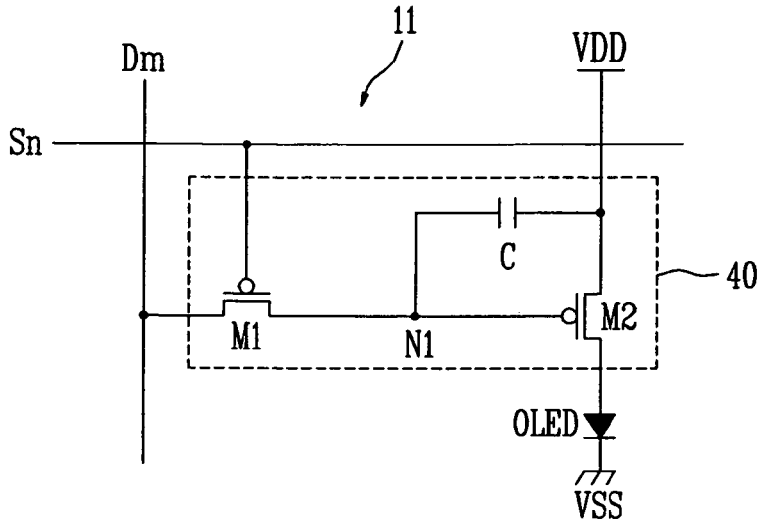
FIG. 1 (PRIOR ART)
FIG. 1 is a circuit diagram of a pixel provided in a conventional organic light emitting display.
Figure 2:
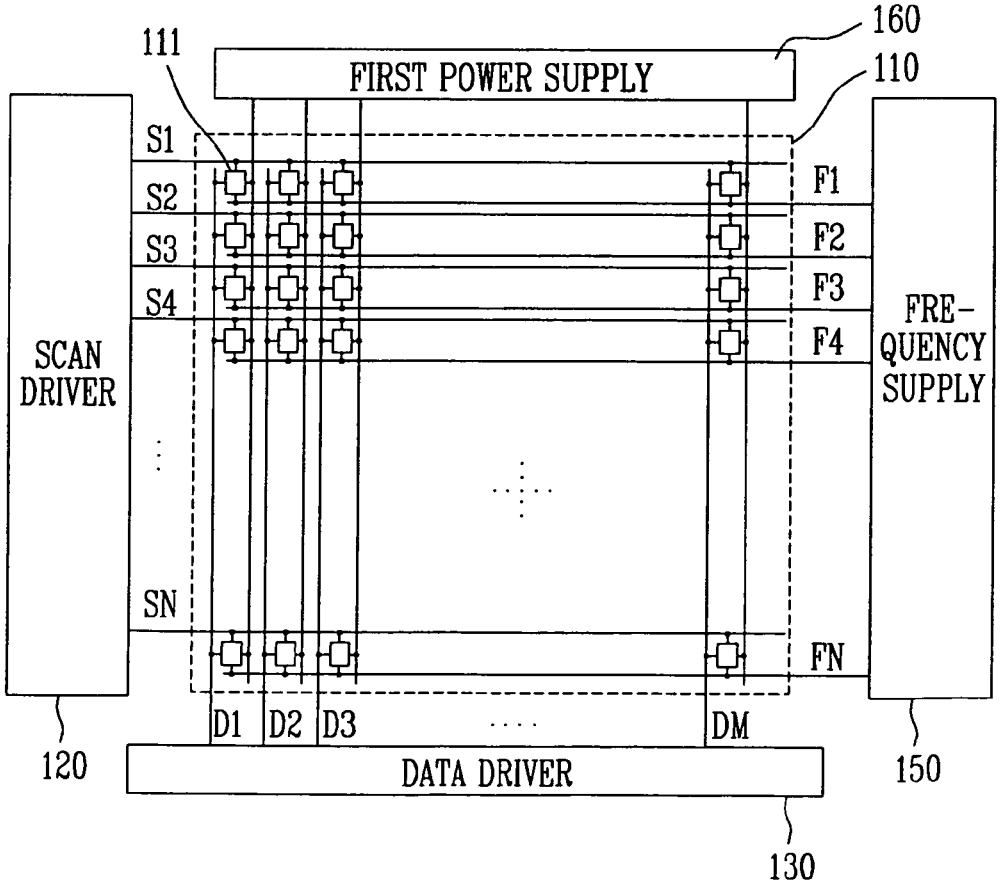
FIG. 2 illustrates a first embodiment of an organic light emitting display including a pixel according to the present invention.

FIG. 2 illustrates a first embodiment of an organic light emitting display including a pixel according to the present invention.

Referring to FIG. 2, the organic light emitting display according to the first embodiment of the present invention includes a pixel portion 110, a scan driver 120, a data driver 130, a first power supply 160 for supplying a first power and a frequency supply 150.

The pixel portion 110 includes a plurality of pixels 111 defined by a plurality of scan lines S1 through SN, a plurality of data lines D1 through DM, a plurality of pixel power source lines, and a plurality of frequency supplying lines F1 through FN. Also, a second power supply (not shown) is provided to supply a second power different from the first power to the plurality of pixels 111.

In operation, a pixel 111 is selected when a scan signal is supplied to a scan line (e.g., one of the scan lines S1 through SN), and emits light corresponding to a data signal supplied to a data line (e.g., the-data line Dm) and a frequency signal supplied to a frequency supplying line (e.g., one of the frequency supplying lines F1 through FN). In more detail, the pixel 111 represents a gradation by controlling its organic light emitting diode OLED to emit light with brightness according to a logical operation between a digital data signal and a frequency signal, thereby displaying an image with a desired brightness.

The scan driver 120 generates the scan signals in response to scan control signals, i.e., a start pulse and a clock signal outputted from a controller (not shown), and supplies them to the scan lines S1 through SN in sequence.

The data driver 130 supplies i-bits digital data signals from the controller to the pixels 111 through the data lines D1 through DM in response to data control signals outputted from the controller. That is, the data driver 130 supplies each bit digital data signal of the i-bits digital data signals (where, i is a positive integer) to the data lines D1 through DM per j sub-frames (where, j is a positive integer equal to or larger than i). At this time, the least significant bit digital data signal among the i-bits digital data signals is supplied to the $1^{st}$ sub-frame. The first power supply 160 supplies the first power to the pixel power source lines of the pixel portion 110. The frequency supply 150 generates the frequency signals that are different according to the sub-frame corresponding to each bit of the i-bits digital data signals, and supplies the frequency signals to the frequency supplying lines F1 through FN. At this time, as the supplied i-bits digital data signal becomes closer to being the most significant bit digital data signal, the frequency of the frequency signal supplied from the frequency supply 150 to the frequency supplying lines F1 through FN becomes closer to being the lowest frequency. Further, the frequency signals supplied to the frequency supplying lines F1 through FN are supplied, synchronizing with the scan signals supplied to the scan lines.

Figure 3:
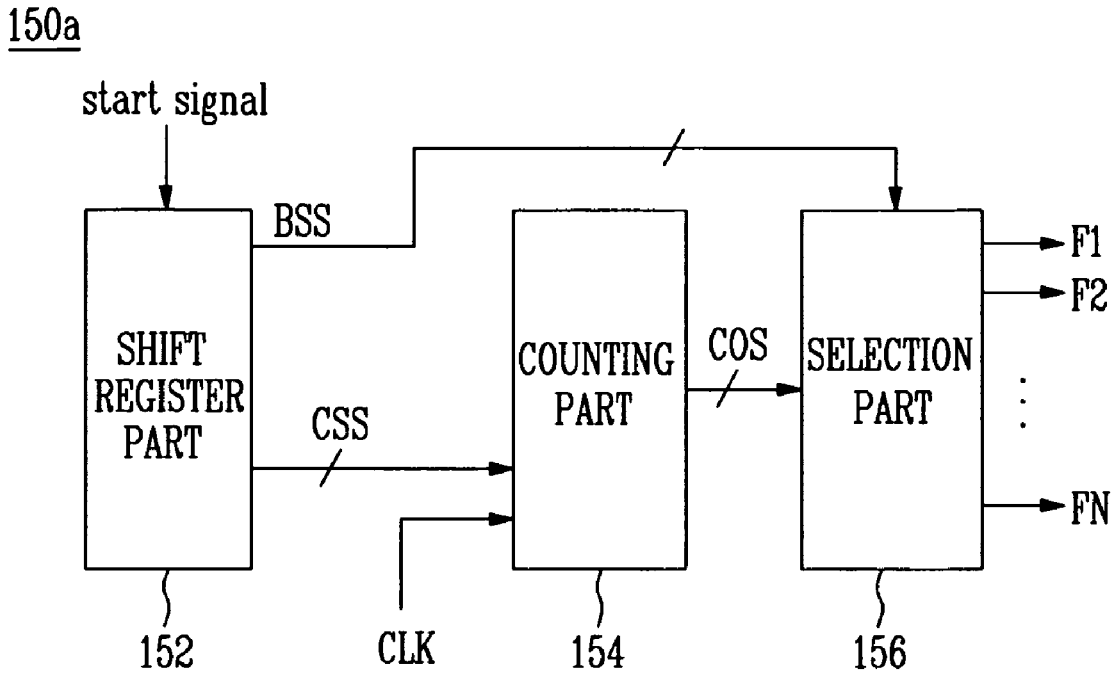
FIG. 3 is a block diagram showing a first embodiment of a frequency supply illustrated in FIG. 2.

FIG. 3 is a block diagram showing a first embodiment of a frequency supply illustrated in FIG. 2.

Referring to FIG. 3, the frequency supply 150*a* includes a shift register part 152, a counting part 154, and a selection part 156.

The shift register part 152 includes a plurality of shift registers. The respective shift registers sequentially shift a start signal that is supplied for synchronizing with a scan signal and supply the shifted start signal to the counting part 154 and the selection part 156. Further, the respective shift registers generate a counting start signal CSS and supply it to the counting part 154. Also, the respective shift registers generate bit selection signals (BBS) by shifting k bits (where, k is a positive integer) in sequence, and supply the bit selection signals to the selection part 156. For example, when the digital data signal is of 8 bits and there are eight sub-frames, each shift register outputs the bit selection signal of 3 bits to the selection part 156.

The counting part 154 includes a plurality of p-bits counters. The respective counters start operating in response to the counting start signal CSS and generate a plurality of counting output signals COS having frequencies that are different according to the clock signal CLK, and supply the plurality of counting output signals COS to the selection part 156.

The selection part 156 includes a plurality of bit selectors. Here, each bit selector may be formed by an analog switch. Further, each bit selector selects one of the counting output signals COS supplied from each counter on the basis of the bit selection signal BSS, and supplies it to the frequency supplying lines F1 through FN. Thus, the selection part 156 generates frequency signals that are different per sub-frame and supplies the generated frequency signals to the frequency supplying lines F1 through FN. In result, as the supplied i-bits digital data signal becomes closer to being the most significant bit digital data signal, the frequency of the frequency signal selected by the selection part 156 and sequentially supplied to the frequency supplying lines F1 through FN becomes closer to being the lowest frequency.

Figure 4:
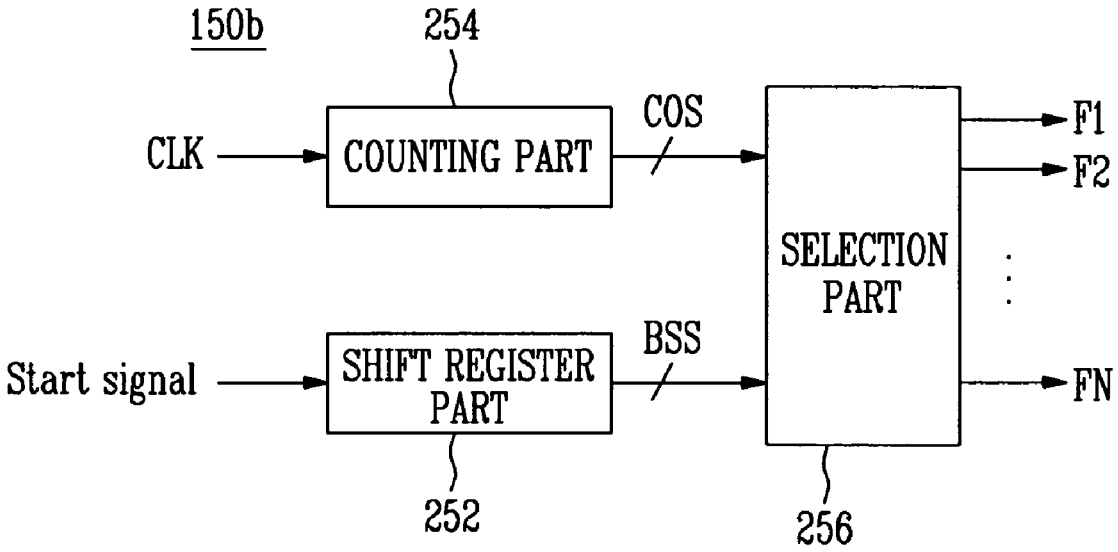
FIG. 4 is a block diagram showing a second embodiment of a frequency supply illustrated in FIG. 2.

FIG. 4 is a block diagram showing a second embodiment of a frequency supply illustrated in FIG. 2.

Referring to FIG. 4, the frequency supply 150*b* includes a counting part 254, a shift register part 252, and a selection part 256.

The counting part 254 generates a plurality of counting output signals COS having frequencies that are different according to the clock signal CLK that is started and inputted in response to a counting start signal CSS, and supplies the plurality of counting output signals COS to the selection part 256. At this time, the counting part 254 generates the plurality of counting output signals COS having different frequencies corresponding to the respective bits of the i-bits digital data signal (or the respective sub-frames), and supplies the plurality of counting output signals COS to the selection part 256.

The shift register part 252 includes a plurality of shift registers. Each shift register sequentially shifts a start signal that is supplied for synchronizing with a scan signal and supplies the shifted start signal to the selection part 256. Further, each shift register generates bit selection signals BBS by shifting k bits (where, k is a positive integer) in sequence, and supplies the bit selection signals to the selection part 256. For example, when the digital data signal is of 8 bits and there are eight sub-frames, each shift register outputs the bit selection signal (BSS) of 3 bits to the selection part 256.

The selection part 256 includes a plurality of bit selectors. Here, each bit selector may be formed by an analog switch. Further, each bit selector selects one of the counting output signals COS having different frequencies on the basis of the bit selection signal BSS, and supplies it to the frequency supplying lines F1 through FN. Thus, the selection part 256 generates frequency signals that are different per sub-frame and supplies the generated frequency signals to the frequency supplying lines F1 through FN. In result, as the supplied i-bits digital data signal becomes closer to being the most significant bit digital data signal, the frequency of the frequency signal selected by the selection part 256 and sequentially supplied to the frequency supplying lines F1 through FN becomes closer to being the lowest frequency.

Figure 5:
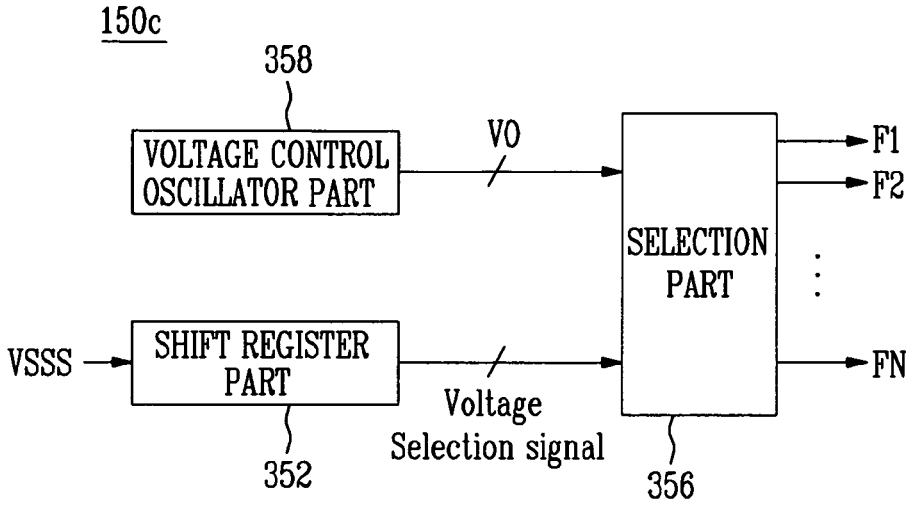
FIG. 5 is a block diagram showing a third embodiment of a frequency supply illustrated in FIG. 2.

FIG. 5 is a block diagram showing a third embodiment of a frequency supply illustrated in FIG. 2.

Referring to FIG. 5, the frequency supply 150*c* includes a voltage control oscillator part 358, a shift register part 352, and a selection part 356.

The voltage control oscillator part 358 includes a plurality of voltage control oscillators. The respective voltage control oscillators generate a plurality of different frequency signals VO using different voltages, and supplies the plurality of different frequency signals VO to the selection part 356. That is, as the supplied i-bits digital data signal becomes closer to being the most significant bit digital data signal, the frequency of the frequency signal VO generated by the voltage control oscillator part 358 and supplied to the selection part 356 becomes closer to being the lowest frequency.

The shift register part 352 includes a plurality of shift registers. The respective shift registers sequentially shift voltage selection start signals VSSS that are supplied for synchronizing with scan signals and then supplies the shifted voltage selection start signals to the selection part 356. That is, the respective shift registers output the sequentially shifted voltage selection signals to the selection part 356. At this time, the respective shift registers generate the voltage selection signals by shifting k bits in sequence, and then supply the voltage selection signals to the selection part 356. For example, when the digital data signal is of 8 bits and there are eight sub-frames, each shift register outputs the voltage selection signal of 3 bits to the selection part 356.

The selection part 356 includes a plurality of voltage selectors. Here, each voltage selector may be formed by an analog switch. Further, each voltage selector selects one of the different frequency signals VO supplied from the voltage control oscillator part 358 in correspondence to the voltage selection signals supplied from the respective shift registers, and supplies the selected frequency signals to the frequency supplying lines F1 through FN. Thus, the selection part 356 selects frequency signals that are different per sub-frame and supplies the generated frequency signals to the frequency supplying lines F1 through FN.

In result, as the supplied i-bits digital data signal becomes closer to being the most significant bit digital data signal, the frequency of the frequency signal selected by the selection part 356 and sequentially supplied to the frequency supplying lines F1 through FN becomes closer to being the lowest frequency.

Figure 6:
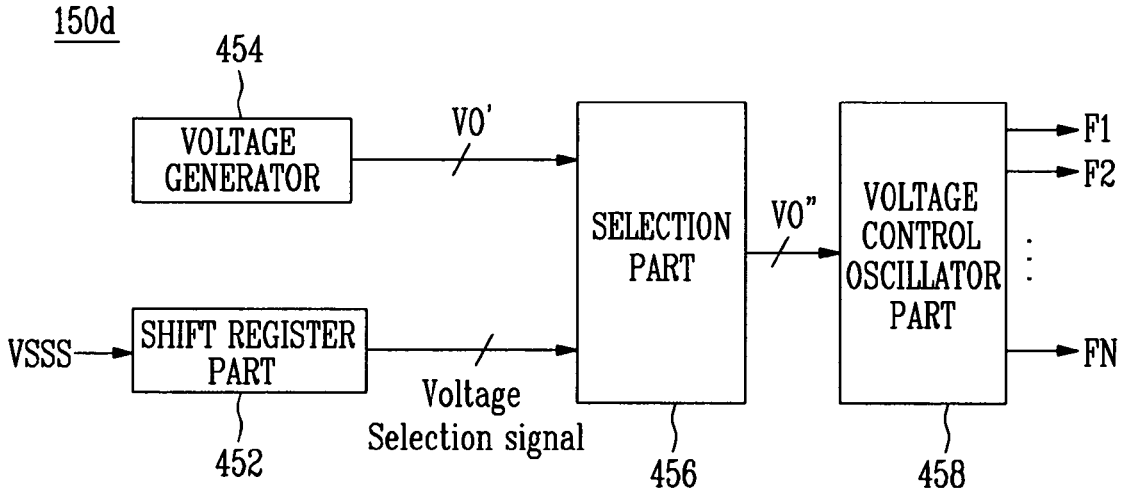
FIG. 6 is a block diagram showing a fourth embodiment of a frequency supply illustrated in FIG. 2.

FIG. 6 is a block diagram showing a fourth embodiment of a frequency supply illustrated in FIG. 2.

Referring to FIG. 6, the frequency supply 150*d* includes a voltage generator 454, a shift register part 452, a selection part 456, and a voltage control oscillator part 458.

The voltage generator 454 generates a plurality of voltages VO' having different levels, and supplies the voltages to the selection part 456.

The shift register part 452 includes a plurality of shift registers. The respective shift registers sequentially shift voltage selection start signals VSSS that are supplied for synchronizing with scan signals and then supplies the shifted voltage selection start signals to the selection part 456. That is, the respective shift registers output the sequentially shifted voltage selection signals to the selection part 456. At this time, the respective shift registers generate the voltage selection signals by shifting k bits in sequence, and then supply the voltage selection signals to the selection part 456. For example, when the digital data signal is of 8 bits and there are eight sub-frames, each shift register outputs the voltage selection signal of 3 bits to the selection part 456.

The selection part 456 includes a plurality of voltage selectors. Here, each voltage selector may be achieved by an analog switch. Further, each voltage selector selects one of the different voltages VO' supplied from the voltage generator 454 in correspondence to the voltage selection signals supplied from the respective shift registers, and supplies the selected voltage VO" to the voltage control oscillator part 458.

The voltage control oscillator part 458 includes a plurality of voltage control oscillators. Each voltage control oscillator generates a frequency signal corresponding to the voltage VO" selected by the voltage selector, thereby supplying the frequency signals VO to the frequency supplying lines F1 through FN. Thus, the voltage control oscillator part 458 generates frequency signals that are different per sub-frame and supplies the generated frequency signals to the frequency supplying lines F1 through FN. In result, as the supplied i-bits digital data signal becomes closer to being the most significant bit digital data signal, the frequency of the frequency signal generated by the voltage control oscillator part 458 and sequentially supplied to the frequency supplying lines F1 through FN becomes closer to being the lowest frequency.

Figure 7:
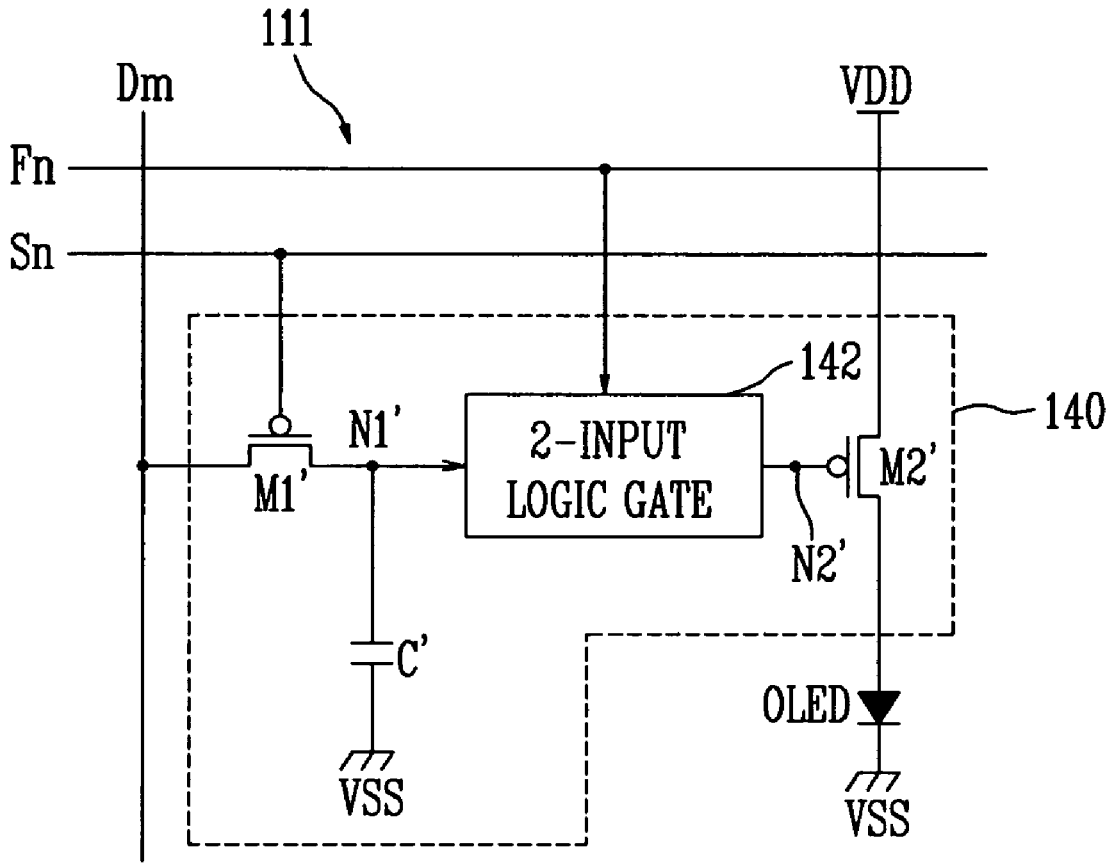
FIG. 7 is a circuit diagram of a pixel illustrated in FIG. 2.

FIG. 7 is a circuit diagram of a pixel illustrated in FIG. 2.

Referring to FIG. 7, the pixel 111 of the organic light emitting display of FIG. 2 is connected to a first power source VDD and a second power source VSS, and includes an organic light emitting diode OLED and a pixel circuit 140.

The organic light emitting diode OLED includes an anode electrode connected to the pixel circuit 140, and a cathode electrode connected to the second power source VSS.

The organic light emitting diode OLED includes an emitting layer, an electron transport layer, and a hole transport layer, which are interposed between the anode electrode and the cathode electrode. Additionally, the organic light emitting diode OLED may include an electron injection layer, and a hole injection layer. In this organic light emitting diode OLED, when a voltage is applied between the anode electrode and the cathode electrode, electrons emitted from the cathode electrode are moved to the emitting layer via the electron injection layer and the electron transport layer, and holes generated from the anode electrode are moved to the emitting layer via the hole injection layer and the hole transport layer. Then, the electrons from the electron transport layer and the holes from the hole transport layer are collided and recombined with each other in the emitting layer, thereby emitting the light.

The pixel circuit 140 includes a first transistor M1', a second transistor M2', a 2-input logic gate 142, and a capacitor C'. Here, each of the first and second transistors M1' and M2' includes a p-type metal oxide semiconductor field effect transistor (MOSFET). In this case where the pixel circuit 140 include the p-type transistors, the second power source VSS has a lower voltage level than the first power source VDD. For example, the second power source VSS can have a ground voltage level.

The first transistor M1' includes a gate electrode connected to a scan line Sn, a source electrode connected to a data line Dm, a drain electrode connected to a first node N1'. Here, the first transistor M1' supplies a digital data signal from the data line Dm to the first node N1' in response to the scan signal supplied to the scan line Sn'.

The second transistor M2' includes a gate electrode connected to a second node N2' to which the 2-input logic gate 142 is connected. The 2-input logic gate 142 is also connected to the drain electrode of the first transistor M1' and the capacitor C' via the first node N1'. The second transistor M2' further includes a source electrode connected to the first power source VDD and a drain electrode connected to the anode electrode of the organic light emitting diode OLED. Here, the second transistor M2' is used to adjust the amount of current flowing from the first power source VDD and applied to the organic light emitting diode OLED in correspondence to the voltage supplied from the capacitor C' to its own gate electrode.

The capacitor C' includes a first electrode electrically connected to the first node N1', and then to the gate electrode of the second transistor M2' (via the 2-input logic gate 142), and a second electrode electrically connected to the second power source VSS. Here, the capacitor C' stores the digital data signal supplied to the first node N1' via the first transistor M1' while the scan signal is transmitted to the scan line Sn, and then supplies the stored digital data signal to the 2-input logic gate 142 when the first transistor M1 is turned off.

The 2-input logic gate 142 logically operates the digital data signal supplied through the first node N1' and a frequency signal supplied through a frequency supplying line Fn, and outputs an output signal to the gate electrode of the second transistor M2' through an output terminal via the second node N2'.

Figure 8:
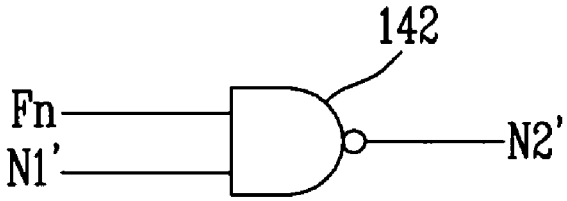
FIG. 8 is a circuit diagram of a 2-input logic gate illustrated in FIG. 7.

FIG. 8 is a circuit diagram of a 2-input logic gate illustrated in FIG. 7.

Referring to FIG. 8, the 2-input logic gate 142 includes a first input terminal connected to the frequency supplying line Fn, and a second input terminal connected to the first node N1', and an output terminal connected to the second node N2' that is connected to the gate electrode of the second transistor M2'. The 2-input logic gate 142 can include an AND gate, a NAND gate, an OR gate, an NOR gate, etc. In one embodiment of the invention, the NOR gate is used as the 2-input logic gate 142. In FIG. 8, the NAND gate is shown as the 2-input logic gate 142.

In the 2-input logic gate 142, the first input terminal receives the frequency signal through the frequency supplying line Fn, and the second input terminal receives the voltage through the first node N1'.

In FIG. 8, the 2-input logic gate 142 outputs the output signal obtained by applying an NAND operation to the frequency signal received through the first input terminal and the digital data signal received from the capacitor C' through the second input terminal to the gate electrode of the second transistor M2' through its output terminal. For example, when the digital data signal of "1" is supplied from the capacitor C', the 2-input logic gate 142 outputs the output signal alternating between "0" and "1" to the gate electrode of the second transistor M2' via the second node N2' according to the frequency signal. Then, the second transistor M2' adjusts the frequency of the current flowing from the first power source VDD to the organic light emitting diode OLED on the basis of the output signal outputted from the 2-input logic gate 142 and alternating between "0" and "1" according to the frequency signal. On the other hand, when the digital data signal of "0" is supplied from the capacitor C', the 2-input logic gate 142 outputs the output signal of "1" to the gate electrode of the second transistor M2' via the second node N2' regardless of the frequency signal. Then, the second transistor M2' is kept being turned off by the output signal of "1" from the 2-input logic gate 142, thereby interrupting the current flowing from the first power source VDD to the organic light emitting diode OLED.

In result, the 2-input logic gate 142 adjusts the frequency of the current flowing in the organic light emitting diode OLED on the basis of the digital data signal and the frequency signal. At this time, the first embodiment of the organic light emitting display according to the present invention can change the power supplied to the organic light emitting diode OLED on the basis of the frequency characteristic of a capacitance in the organic light emitting diode OLED, thereby representing a desired brightness.

Figure 9:
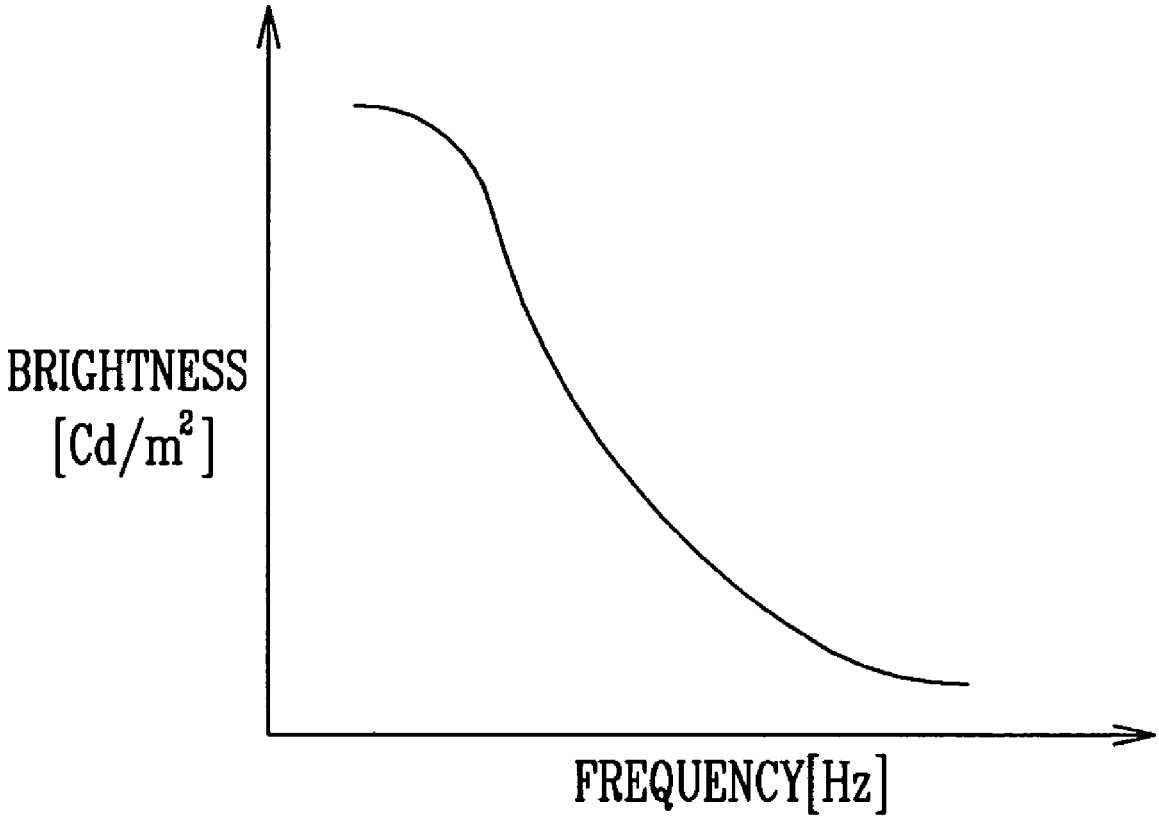
FIG. 9 is a graph showing brightness with respect to the frequency of an organic light emitting diode illustrated in FIG. 7.

FIG. 9 is a graph showing brightness with respect to the frequency of an organic light emitting diode illustrated in FIG. 7.

Referring to FIG. 9, the capacitance in the organic light emitting diode OLED causes brightness to decrease with a high frequency (Hz) and to increase with a low frequency (Hz). Thus, the light emitting diode OLED represents high brightness ($Cd/m^2$) and low brightness ($Cd/m^2$) corresponding to low frequency (Hz) and high frequency (Hz), respectively.

Figure 10:
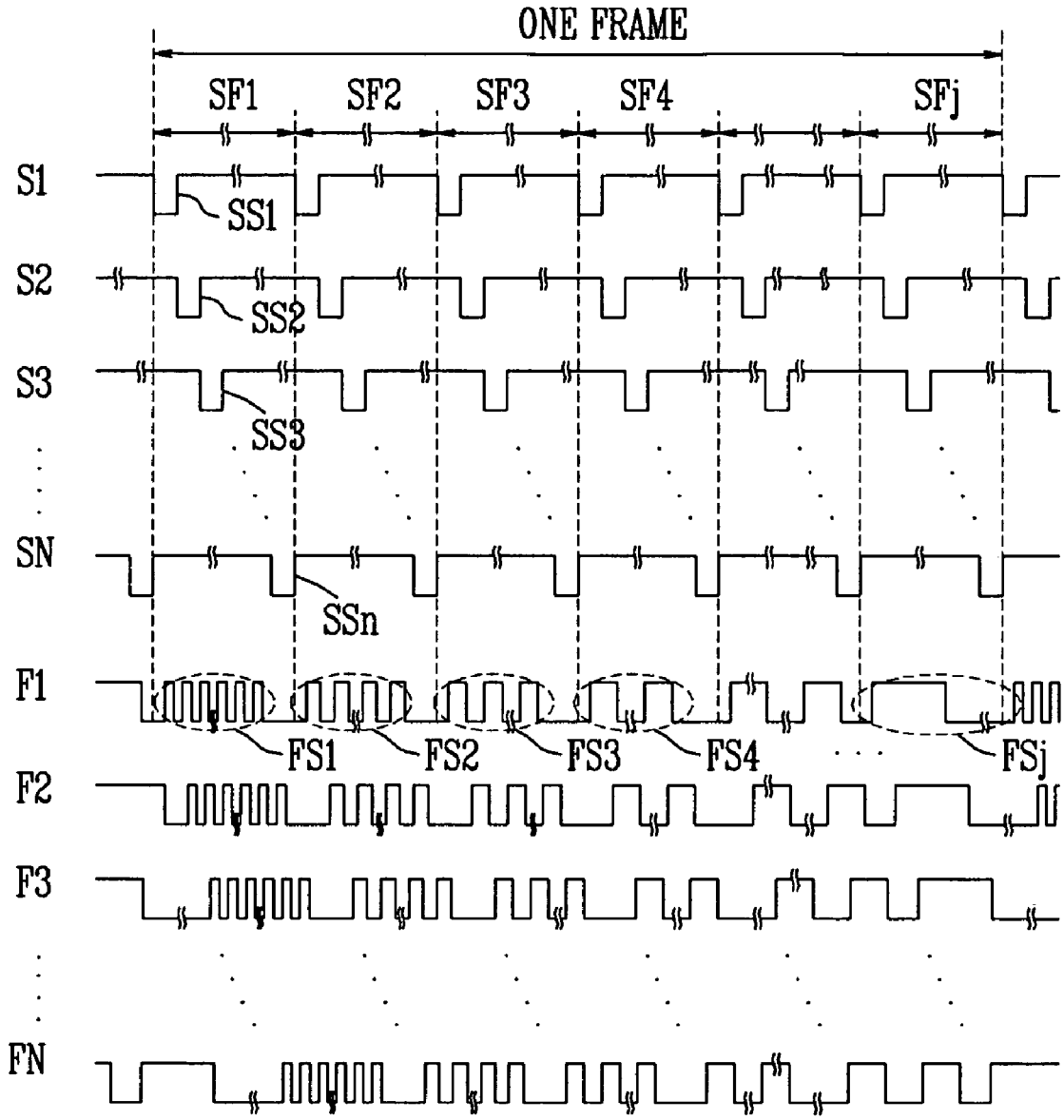
FIG. 10 shows driving waveforms for the first embodiment of the organic light emitting display including the pixel according to the present invention.

FIG. 10 shows driving waveforms for the first embodiment of the organic light emitting display including the pixel according to the present invention.

Referring to FIG. 10 in accordance with FIG. 7, one frame is divided into j sub-frames SF1 through SFj corresponding to the respective bits of the i-bits digital data signals and having the same emission time to thereby adjust the brightness of the organic light emitting diode OLED and representing a desired gradation. Here, the first through $j^{th}$ sub-frames SF1 through SFj are different in the gradations corresponding to differently weighted brightness. For example, the gradations corresponding to the brightness of the first through $j^{th}$ sub-frames SF1 through SFj are in the ratio of $2^0:2^1:2^2:2^3:2^4:2^5:\ldots:2^j$.

According to the first embodiment of the present invention, the organic light emitting display including the pixel is driven as follows.

First, the scan signals SS1 through SSn of the low state are supplied to the respective scan lines S1 through SN in the $1^{st}$ sub-frame SF1 of one frame, so that a plurality of first transistors M1' connected to the respective scan lines S1 through Sn are turned on in sequence. At the same time, first frequency signals FS1 are supplied to the second input terminal of the 2-input logic gate 142 via the respective frequency supplying lines F1 through FN in synchronization with the scan signals SS1 through SSn of the low state. Thus, the $1^{st}$ bit digital data signal among the i-bit digital data signals supplied to the data lines D1 through DM is supplied to each first transistor M1' and each first node N1'. Therefore, each capacitor C' is charged with a voltage difference between the $1^{st}$ bit digital data supplied to the respective first node N1' and the second power source VSS.

Then, the scan signals SS1 through SSn of the high state are supplied to the respective scan lines S1 through SN, so that the $1^{st}$ bit digital data signal stored in each capacitor C' is supplied to the first input terminal of the 2-input logic gate 142 via the first node N1. Then, each 2-input logic gate 142 applies a logical operation (e.g., the NAND operation) to the $1^{st}$ bit digital data signal from the capacitor C' and the $1^{st}$ frequency signal FS1 from the frequency supplying line F1 through FN and outputs the output signal obtained by the logical operation to the gate electrode of the second transistor M2', thereby turning on and off the second transistor M2'. The second transistor M2' is turned on and off by the output signal of the 2-input logic gate 142, and allows the current to flow from the first power source VDD to the organic light emitting diode OLED.

Hence, in the $1^{st}$ sub-frame SF1, the organic light emitting diode OLED emits light based on the current supplied as the second transistor M2' is turned on and off. At this time, the brightness of the organic light emitting diode OLED decreases with the high frequency and increases with the low frequency because of the capacitance in the organic light emitting diode OLED, and thus this frequency characteristic makes the organic light emitting diode emit light on the basis of the frequency of the current supplied from the second transistor M2'. For example, the organic light emitting diode OLED emits light with brightness corresponding to the gradation of "0" or "$2^0$" on the basis of the $1^{st}$ bit digital data signal in the $1^{st}$ sub-frame SF1. That is, the organic light emitting diode OLED emits light with brightness corresponding to the gradation of "$2^0$" when the $1^{st}$ bit digital data signal is "1", but does not emit light when the $1^{st}$ bit digital data signal is "0".

Further, the scan signals SS1 through SSn of the low state are supplied to the respective scan lines S1 through SN in the $2^{nd}$ sub-frame SF2 of one frame, so that the first transistors M1' connected to the respective scan lines S1 through Sn are turned on in sequence. At the same time, second frequency signals FS2 having a lower frequency than the first frequency signals FS1 are supplied to the second input terminal of the 2-input logic gate 142 via the respective frequency supplying lines F1 through FN, synchronizing with the scan signals SS1 through SSn of the low state. Thus, the $2^{nd}$ bit digital data signal among the i-bit digital data signals supplied to the data lines D1 through DM is supplied to each first transistor M1' and each first node N1'. Therefore, each capacitor C' is charged with voltage difference between the $2^{nd}$ bit digital data supplied to the first node N1' and the second power source VSS.

Then, the scan signals SS1 through SSn of the high state are supplied to the respective scan lines S1 through SN, so that the $2^{nd}$ bit digital data signal stored in each capacitor C' is supplied to the first input terminal of the 2-input logic gate 142 via the first node N1. Then, each 2-input logic gate 142 applies a logical operation (e.g., the NAND operation) to the $2^{nd}$ bit digital data signal from the capacitor C' and the $2^{nd}$ frequency signal FS2 from the frequency supplying line F1 through FN and outputs the output signal obtained by the logical operation to the gate electrode of the second transistor M2', thereby turning on and off the second transistor M2'. The second transistor M2' is turned on and off by the output signal of the 2-input logic gate 142, and allows the current to flow from the first power source VDD to the organic light emitting diode OLED.

Hence, in the $2^{nd}$ sub-frame SF2, the organic light emitting diode OLED emits light based on the current supplied as the second transistor M2' is turned on and off. At this time, the organic light emitting diode OLED emits light on the basis of the frequency of the current supplied from the first power source VDD according to when the second transistor M2 is turned on and off. For example, the organic light emitting diode OLED emits light with brightness corresponding to the gradation of "0" or "$2^1$" on the basis of the $2^{nd}$ bit digital data signal in the $2^{nd}$ sub-frame SF2. That is, the organic light emitting diode OLED emits light with brightness corresponding to the gradation of "$2^1$" when the $2^{nd}$ bit digital data signal is of "1", but does not emit light when the $2^{nd}$ bit digital data signal is of "0".

Also, in the $3^{rd}$ sub-frame SF3 of one frame, the organic light emitting diode OLED emits light on the basis of the frequency of the current supplied from the first power source VDD according to when the second transistor M2' is turned on and off by the logical operation between the $3^{rd}$ bit digital data signal and the $3^{rd}$ frequency signal FS3 having a lower frequency than the $2^{nd}$ frequency signal FS2. Therefore, the organic light emitting diode OLED emits light with brightness corresponding to the gradation of "0" or "$2^2$" on the basis of the $3^{rd}$ bit digital data signal in the $3^{rd}$ sub-frame SF3. That is, the organic light emitting diode OLED emits light with brightness corresponding to the gradation of "$2^2$" when the $3^{rd}$ bit digital data signal is of "1", but does not emit light when the $3^{rd}$ bit digital data signal is of "0".

Likewise, in each of the $4^{th}$ through $j^{th}$ sub-frames SF4 through SFj of one frame, the organic light emitting diode OLED emits light with brightness corresponding to the gradation of "0" or "$2^3$" through "$2^i$" on the basis of the frequency of the current supplied from the first power source VDD according to when the second transistor M2' is turned on and off by the logical operation between each of the $4^{th}$ through $j^{th}$ bit digital data signals and the $4^{th}$ through $j^{th}$ frequency signal FS4 through FSj that are lowered in sequence.

Thus, an organic light emitting display including a pixel according to the above-described embodiments of the present invention uses a frequency characteristic of an organic light emitting diode OLED to thereby represent a desired gradation according to the sum of brightness weights of the light emitted from the organic light emitting diode OLED per sub-frame SF1 through SFj.

Figure 11:
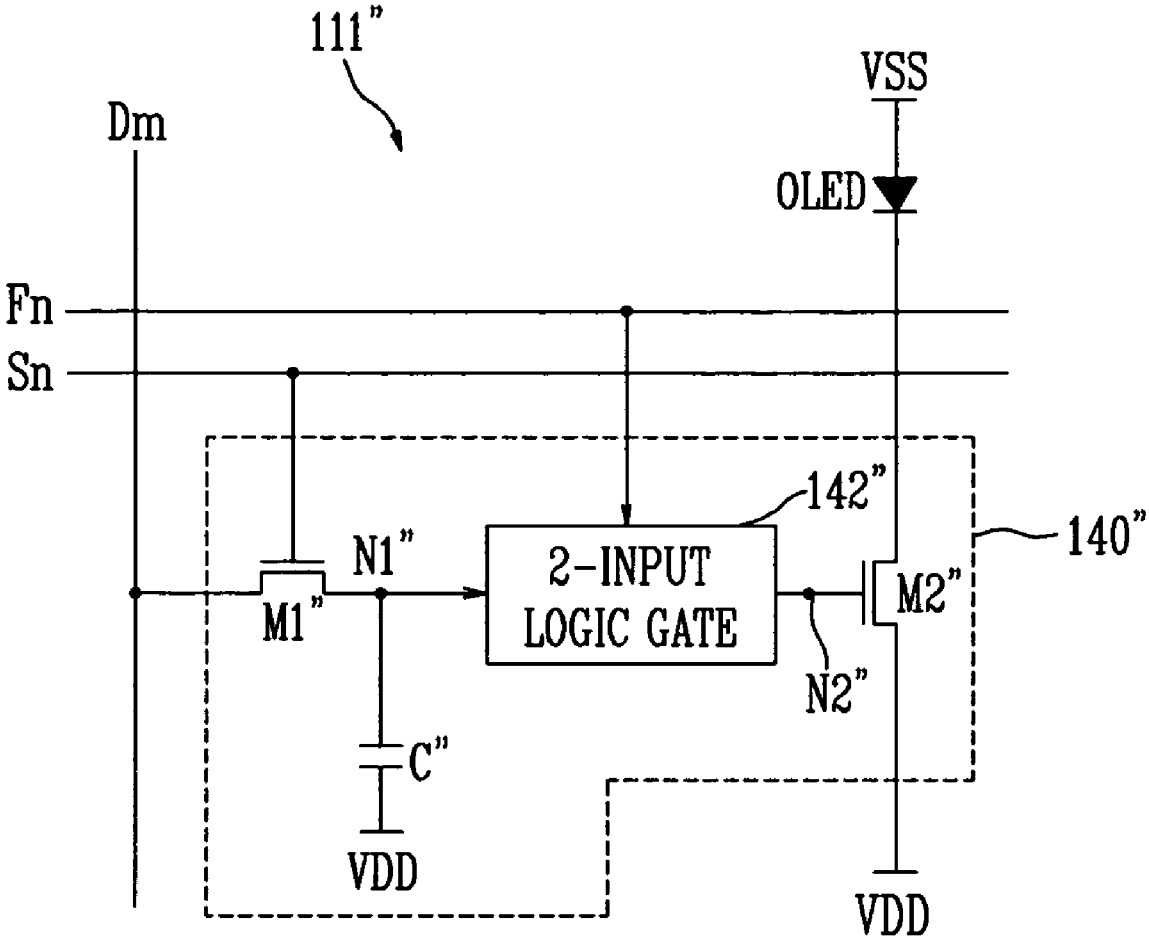
FIG. 11 illustrates a pixel of a second embodiment of an organic light emitting display according to the present invention.
Figure 12:
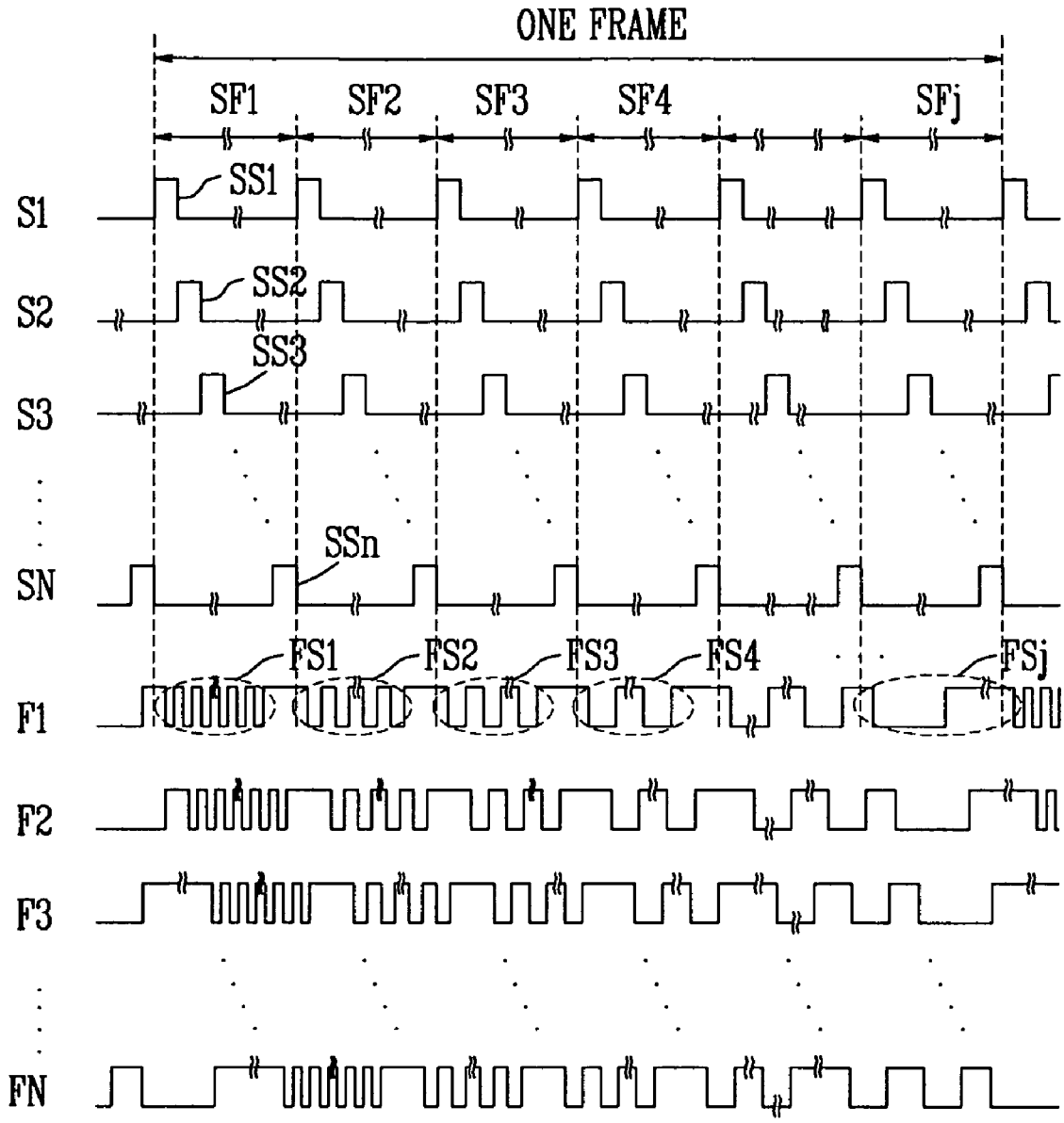
FIG. 12 shows driving waveforms for the second embodiment of the organic light emitting display including the pixel according to the present invention.

FIG. 11 illustrates a pixel of a second embodiment of an organic light emitting display according to the present invention, and FIG. 12 shows driving waveforms for the second embodiment of the organic light emitting display including the pixel according to the present invention.

Referring to FIGS. 11 and 12, the pixel 111" includes a pixel circuit having transistors M1" and M2", a capacitor C", first and second nodes N1" and N2", and a 2-input logic gate 142". The pixel 111" of FIG. 11 is different from that of the pixel 111 of FIG. 7 in the conductive type of the transistor M1" and M2" provided in the pixel circuit 140", but the structures and configurations of the other components, such as the first and second nodes N1" and N2", the capacitor C" and the 2-input logic gate 142", are substantially the same as that of the pixel 111 of FIG. 7.

In the pixel according to the second embodiment of the organic light emitting display of the present invention, a scan signal is provided for driving n-type transistors M1" and M2". The second embodiment of the organic light emitting display can be readily appreciated by those skilled in the art with reference to the first embodiment of the organic light emitting display. Therefore, repetitive descriptions will be avoided as necessary.

In the foregoing embodiments, a pixel (e.g., the pixel 111 or the pixel 111") includes two transistors (e.g., the transistors M1 and M2 or the transistors M1" and M2"), and one capacitor (e.g., the capacitor C or the capacitor C"), but the present invention is not thereby limited. Alternatively, for example, the pixel may include at least two transistors and at least one capacitor.

In the foregoing embodiment, respective sub-frames have the same emission time, but the present invention is not thereby limited. Alternatively, for example, the respective sub-frames may have different emission times to improve gradation representation and picture quality.

Further, a pixel, an organic light emitting display including the same, and a driving method thereof in certain embodiments of the present invention may be applied to a display that displays an image by controlling a current.

As described above, the present invention provides a pixel, an organic light emitting display including the same, and a driving method thereof, in which a desired gradation is represented using a frequency characteristic of an organic light emitting diode on the basis of the sum of various brightnesses depending on a digital data signal and frequency signals that are different per sub-frame. Further, the emission times of the respective sub-frames are equalized in the digital driving manner, so that there is enough time to adjust the ratio of the emission times, thereby providing enough time for the gradation representation. Also, an image is displayed using the digital driving manner, so that the brightness thereof is uniform regardless of difference between transistors provided in pixels.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An organic light emitting display for displaying an image during a frame comprising a plurality of sub-frames, the organic light emitting display comprising a plurality of pixels coupled to a plurality of scan lines for supplying scan signals, a plurality of data lines for supplying data signals, and a plurality of power source lines, each of the pixels comprising:

a frequency supplying line for supplying a frequency signal corresponding to a sub-frame among the plurality of sub-frames;

a pixel circuit for outputting a current corresponding to an output obtained by applying a logical operation to a corresponding one of the data signals and the frequency signal; and an organic light emitting diode for emitting light based on the current outputted from the pixel circuit, wherein the pixel circuit comprises:

a first transistor controlled by a corresponding one of the scan signals supplied to a corresponding one of the scan lines and for outputting the corresponding one of the data signals supplied to a corresponding one of the data lines;

a logic gate for outputting an output signal obtained by applying a logical operation to an output from the first transistor and the frequency signal from the frequency supplying line;

a second transistor for being turned on and off by the output signal of the logic gate and for supplying the current from a corresponding one of the power source lines to the organic light emitting diode; and a capacitor for storing the corresponding one of the data signals from the first transistor and for supplying the stored data signal to the logic gate, and wherein the logic gate comprises:

a first input terminal coupled to an output electrode of the first transistor;

a second input terminal coupled to the frequency supplying line; and an output terminal coupled to a gate electrode of the second transistor.

2. The organic light emitting display according to clam 1, wherein each of the pixels represents a gradation based on a brightness sum of the light emitted by the organic light emitting diode per sub-frame.

3. The organic light emitting display according to claim 1, wherein the corresponding one of the data signals includes i bits corresponding to j sub-frames, and wherein i is a positive integer and j is a positive integer not less than i.

4. The organic light emitting display according to claim 1, wherein a frequency of the frequency signal being supplied becomes closer to being a lowest frequency as a bit of the corresponding one of the data signals being supplied becomes closer to being a most significant bit of the corresponding one of the data signals.

5. The organic light emitting display according to claim 1, wherein the frequency signal is supplied to synchronize with a corresponding one of the scan signals supplied to a corresponding one of the scan lines.

6. The organic light emitting display according to claim 1, wherein the logic gate includes a 2-input logic gate.

7. An organic light emitting display for displaying an image during a frame comprising a plurality of sub-frames, the organic light emitting display comprising:

a pixel portion comprising a plurality of pixels coupled to a plurality of scan lines, a plurality of data lines, a plurality of power source lines, and a plurality of frequency supplying lines, and for emitting light based on a current depending on a logical operation applied between a digital data signal supplied to the data lines and a frequency signal supplied to the frequency supplying lines;

a data driver for supplying the digital data signal to at least one of the data lines;

a scan driver for supplying a scan signal to at least one of the scan lines; and a frequency supply for supplying the frequency signal to at least one of the frequency supplying lines;

wherein each pixel of the plurality of pixels comprises:

a first transistor controlled by a corresponding one of the scan signals supplied to a corresponding one of the scan lines and for outputting the corresponding one of the digital data signals supplied to a corresponding one of the data lines;

a logic gate for outputting an output signal obtained by applying a logical operation to an output from the first transistor and the frequency signal from the frequency supplying line;

a second transistor for being turned on and off by the output signal of the logic gate and for supplying the current from a corresponding one of the power source lines to the organic light emitting diode; and a capacitor for storing the corresponding one of the digital data signals from the first transistor and for supplying the stored digital data signal to the logic gate; and wherein the logic gate comprises:

a first input terminal coupled to an output electrode of the first transistor;

a second input terminal coupled to the frequency supplying line; and an output terminal coupled to a gate electrode of the second transistor.

8. The organic light emitting display according to clam 7, wherein each of the pixels represents a gradation based on a brightness sum of light emitted by a corresponding organic light emitting diode per sub-frame.

9. The organic light emitting display according to claim 8, wherein the corresponding one of the digital data signals includes i bits corresponding to j sub-frames, and wherein i is a positive integer and j is a positive integer not less than i.

10. The organic light emitting display according to claim 9, wherein the frequency supply supplies the frequency signal to the at least one of the frequency supplying lines per sub-frame.

11. The organic light emitting display according to claim 10, wherein a frequency of the frequency signal being supplied becomes closer to being a lowest frequency as a bit of the corresponding one of the digital data signals being supplied becomes closer to being a most significant bit of the corresponding one of the digital data signals.

12. The organic light emitting display according to claim 9, wherein each of the pixels further comprises:

a pixel circuit for outputting a current corresponding to the output signal from the logic gate; and an organic light emitting diode for emitting light based on the current outputted from the pixel circuit.

13. The organic light emitting display according to claim 8, wherein the frequency supply comprises:

a voltage generator for generating different voltages;

a shift register part for generating a voltage selection signal corresponding to each sub-frame;

a selection part for selecting and outputting one of the different voltages supplied from the voltage generator in correspondence to the voltage selection signal; and a frequency generator for generating one of 1st through Nth frequency signals in correspondence to the voltage selected by the selection part, and for supplying the selected frequency signal to a corresponding one of the frequency supplying lines.

14. The organic light emitting display according to claim 8, wherein the frequency supply comprises:

a shift register part for generating a start signal and a bit selection signal corresponding to each sub-frame;

a counting part for starting operation by the start signal and for generating 1st through Nth frequency signals according to inputted clock signals, the 1st through Nth frequency signals being different from each other; and a selection part for selecting one of the 1st through Nth frequency signals supplied from the counting part in correspondence to the bit selection signal, and for supplying the selected frequency signal to a corresponding one of the frequency supplying lines.

15. The organic light emitting display according to claim 8, wherein the frequency supply comprises:

a shift register part for generating a bit selection signal corresponding to each sub-frame;

a counting part for generating 1st through Nth frequency signals according to inputted clock signals, the 1st through Nth frequency signals being different from each other; and a selection part for selecting one of the 1st through Nth frequency signals supplied from the counting part in correspondence to the bit selection signal, and for supplying the selected frequency signal to a corresponding one of the frequency supplying lines.

16. The organic light emitting display according to claim 8, wherein the frequency supply comprises:

a frequency generator for generating 1st through Nth frequency signals using different voltages, the 1st through Nth frequency signals being different from each other;

a shift register part for generating a voltage selection signal corresponding to each sub-frame; and a selection part for selecting one of the 1st through Nth frequency signals supplied from the frequency generator in correspondence to the voltage selection signal, and for supplying the selected frequency signal to a corresponding one of the frequency supplying lines.

17. A pixel comprising:

a pixel circuit for outputting a current corresponding to an output obtained by applying a logical operation to an input data signal and a frequency signal;

a scan line for supplying a scan signal;

a data line for supplying the data signal, wherein the data signal includes i bits corresponding to j sub-frames, and wherein i is a positive integer and j is a positive integer not less than i;

a frequency supplying line for supplying the frequency signal, wherein a frequency of the frequency signal being supplied becomes closer to being a lowest frequency as a bit of the data signal being supplied becomes closer to being a most significant bit of the data signal, and wherein the frequency signal is supplied to synchronize with the scan signal supplied on the scan line;

a power source line for supplying a driving voltage; and an organic light emitting diode for emitting light based on the current outputted from the pixel circuit, and for representing a gradation based on a brightness sum of the light emitted by the organic light emitting diode per sub-frame of one frame, wherein the pixel circuit comprises:

a first transistor controlled by the scan signal supplied to the scan line and outputting the data signal supplied the data line;

a logic gate for outputting an output signal obtained by applying a logical operation to an output from the first transistor and the frequency signal from the frequency supplying line;

a second transistor for being turned on and off by the output signal of the logic gate and for supplying the current from the power source line to the organic light emitting diode; and a capacitor for storing the data signal from the first transistor and for supplying the stored data signal to the logic gate, and wherein the logic gate comprises:

a first input terminal coupled to an output electrode of the first transistor;

a second input terminal coupled to the frequency supplying line; and an output terminal coupled to a gate electrode of the second transistor.

18. The pixel according to claim 17, wherein the logic gate includes a 2-input logic gate.

* * * * *